US006827339B1

(12) United States Patent
Wang

(10) Patent No.: US 6,827,339 B1
(45) Date of Patent: Dec. 7, 2004

(54) VARIABLE VENTURI-TYPE CARBURETOR WITH AUTOMATIC VACUUM REGULATION AND CAM CONTROL MECHANISM

(76) Inventor: Ming Ching Wang, No. 45, Alley 7, Lane 170, Tung Hsin St., Nan Kang District, Taipei City (TW)

( * ) Notice: Subject to any disclaimer, the term of this patent is extended or adjusted under 35 U.S.C. 154(b) by 0 days.

(21) Appl. No.: 10/644,028

(22) Filed: Aug. 20, 2003

(51) Int. Cl.[7] ..... F02M 9/14

(52) U.S. Cl. ..... 261/44.5; 261/52; 261/65; 261/DIG. 56

(58) Field of Search ..... 261/44.5, 52, 65, 261/69.1, DIG. 12, DIG. 56

(56) References Cited

U.S. PATENT DOCUMENTS

| | | | | | |
|---|---|---|---|---|---|
| 1,167,290 | A | * | 1/1916 | Glover | 261/44.5 |
| 1,934,240 | A | * | 11/1933 | Scott | 261/34.2 |
| 2,034,048 | A | * | 3/1936 | Leibing et al. | 261/69.1 |
| 2,646,264 | A | * | 7/1953 | Morris | 261/44.5 |
| 3,953,548 | A | * | 4/1976 | Knapp et al. | 261/50.2 |
| 4,088,715 | A | * | 5/1978 | Graybill | 261/36.2 |
| 4,174,361 | A | * | 11/1979 | Rollins | 261/41.4 |
| 4,234,522 | A | * | 11/1980 | Fontanet et al. | 261/23.2 |
| 4,450,119 | A | * | 5/1984 | Kodo | 261/44.5 |
| 4,501,709 | A | * | 2/1985 | Yamamoto et al. | 261/44.5 |
| 4,670,195 | A | * | 6/1987 | Robson | 261/41.5 |
| 6,264,175 | B1 | * | 7/2001 | Wang | 261/44.5 |

FOREIGN PATENT DOCUMENTS

| | | | | |
|---|---|---|---|---|
| JP | 61-19958 | * | 1/1986 | 261/44.5 |
| JP | 61-19959 | * | 1/1986 | 261/44.5 |

* cited by examiner

*Primary Examiner*—Richard L. Chiesa
(74) *Attorney, Agent, or Firm*—Browdy and Neimark, P.L.L.C.

(57) ABSTRACT

A variable venturi-type carburetor has a base defining a central channel having an upper inlet end and a lower outlet end. A variable venturi assembly is situated in the middle of the central channel. The variable venturi assembly has a support, a conical body, and a resilient member. The support is fixed in the base, the bottom of the conical body is movably connected to the support, the surface of the conical body and the base define a venturi throat and the resilient member is situated between the support and the conical body. A fuel reservoir is provided in the base. A path structure connects the fuel reservoir and the venturi throat. A cam control mechanism is also part of the venturi assembly.

7 Claims, 7 Drawing Sheets

VARIABLE VENTURI-TYPE CARBURETOR WITH AUTOMATIC VACUUM REGULATION AND CAM CONTROL MECHANISM

BACKGROUND OF THE INVENTION

1. Field of the Invention

The present invention relates to a variable venturi-type carburetor with automatic vacuum regulation and cam control mechanism. More particularly, the present invention relates to a variable venturi-type carburetor capitalizing on changes of engine vacuum suction force and interaction of the cam to control the upward and downward displacement of a conical body in the variable venturi-type carburetor, thereby adjusting the air/fuel ratio in an appropriate range.

2. Description of the Related Art

Most present automobile carburetors are designed with a fixed venturi to create a vacuum pressure in the induction duct in order to pull fuel from a fuel reservoir. The venturi, by its fixed nature, operates at a maximum efficiency over a small range of engine RPM. Furthermore, a different size venturi is generally required for different size engines in performance requirements. To overcome the inefficiency of the prior art fixed venturi carburetor, various variable venturi carburetors have been developed. Compared to the traditional fixed venturi carburetors, variable venturi carburetors can effectively operate throughout the entire engine operation range.

FIG. 1 is a schematic, cross-sectional view illustrating a prior art variable venturi carburetor. As shown in FIG. 1, the prior art variable venturi carburetor includes a seat 6', a main body 7', an upper lid 8', a variable venturi assembly 2', a fuel reservoir 3', and a path structure 4'. A central channel 10' is defined by the seat 6', the main body 7' and the upper lid 8'. A throttle valve shaft 511' is pivotally installed in the seat 6'. A switching rod 53' is connected to the throttle valve shaft 511'. The main body 7' comprises an upper flange 70' approaching the upper lid 8'. A fixing ring 80', which is fastened on the upper lid with screws, is situated at a position approaching the flange 70' of the main body 7' to define an outlet channel 40'. The variable venturi assembly 2' comprises a support 20', a shaft 211', a conical body 21', and a resilient member 22'. The support 20' is fixed to the main body 7'. A pivot hole 213' is provided in the support 20'. The lower end of the shaft 211' is pivotally connected to the switching rod that is connected to the throttle valve shaft 511'. The conical body 21' is connected and fixed to the upper end of the shaft 211'. The slightly curved surface of the conical body 21' and the flange 70' of the main body 7' define a venturi throat-narrowing channel 13'. The resilient member 22' is installed between the conical body 21' and the support 20' to push the conical body 21' upwards. The path 4' connects the fuel reservoir 3' and the outlet channel 40' to the venturi throat-narrowing channel 13'. By rotating the throttle valve shaft 511', the shaft 211' of the variable venturi assembly 2' descends to change the size of the venturi throat narrowing path 13', thereby obtaining a proper air/fuel ratio.

Since the above-described prior art variable venturi carburetor comprises the variable venturi assembly 2' connected to the throttle valve shaft 511', when braking, a sudden large vacuum suction force is created. When the vacuum suction force increases, the conical body of the variable venturi assembly is upwardly pushed by the resilient member, thereby narrowing the venturi throat channel. However, the above-described prior art variable venturi carburetor cannot control the precise position of the conical body when the sudden large vacuum suction force occurs to obtain an optimal spacing. This leads to an overly rich fuel-air mixture and thus results in air pollution. Furthermore, when the throttle valve is fully open, the spacing of the venturi throat channel is fixed. However, it is known that the power load on the engine varies with different road conditions (e.g. grade). Fixed spacing for a fully open throttle valve causes a waste of fuel when the vehicle moves on low-grade roads and inadequate power when vehicle moves on high-grade roads. Even for engines installed with a horse power regulation ring of vacuum valve controllable by engine vacuum suction force, the decrease of engine vacuum suction force caused by an over-loaded engine will make the vacuum valve lose its self-compensation ability.

SUMMARY OF THE INVENTION

Accordingly, the primary object of the present invention is to provide a variable venturi-type carburetor with automatic vacuum regulation and cam control mechanism for adjusting the air/fuel ratio over a wide operation range, thereby increasing the performance of engines.

To achieve this and other advantages and in accordance with the purposes of the present invention, as embodied and broadly described herein, the present invention provides a variable venturi-type carburetor with automatic vacuum regulation and cam control mechanism. The carburetor according to the invention comprises a base defining a central channel having an upper inlet end and a lower outlet end. A variable venturi assembly is situated in the middle of the central channel, the variable venturi assembly comprising a support, a conical body, and a resilient member. The support is fixed in the base, the bottom of the conical body is movably connected to the support and the surface of the conical body and the base define a venturi throat. The resilient member is situated between the support and the conical body. A fuel reservoir is provided in the base. A path structure connects the fuel reservoir and the venturi throat. A cam control mechanism comprises a cam set, throttle valve set and a connecting mechanism. The cam set is pivotally installed at the upper inlet end of the base, and a cam surface of the cam set abuts a top surface of the conical body of the variable venturi assembly. The throttle valve set is pivotally installed at the lower outlet end of the base, and the throttle valve set comprises a throttle valve for controlling the open/close of the lower outlet end. The connecting mechanism has one end connected to the cam set and the other connected to the throttle valve set.

BRIEF DESCRIPTION OF THE DRAWINGS

Other objects, advantages and novel features of the invention will become more clearly and readily apparent from the following detailed description when taken in conjunction with the accompanying drawings, in which.

DETAILED DESCRIPTION OF THE PREFERRED EMBODIMENTS

Figure 1:
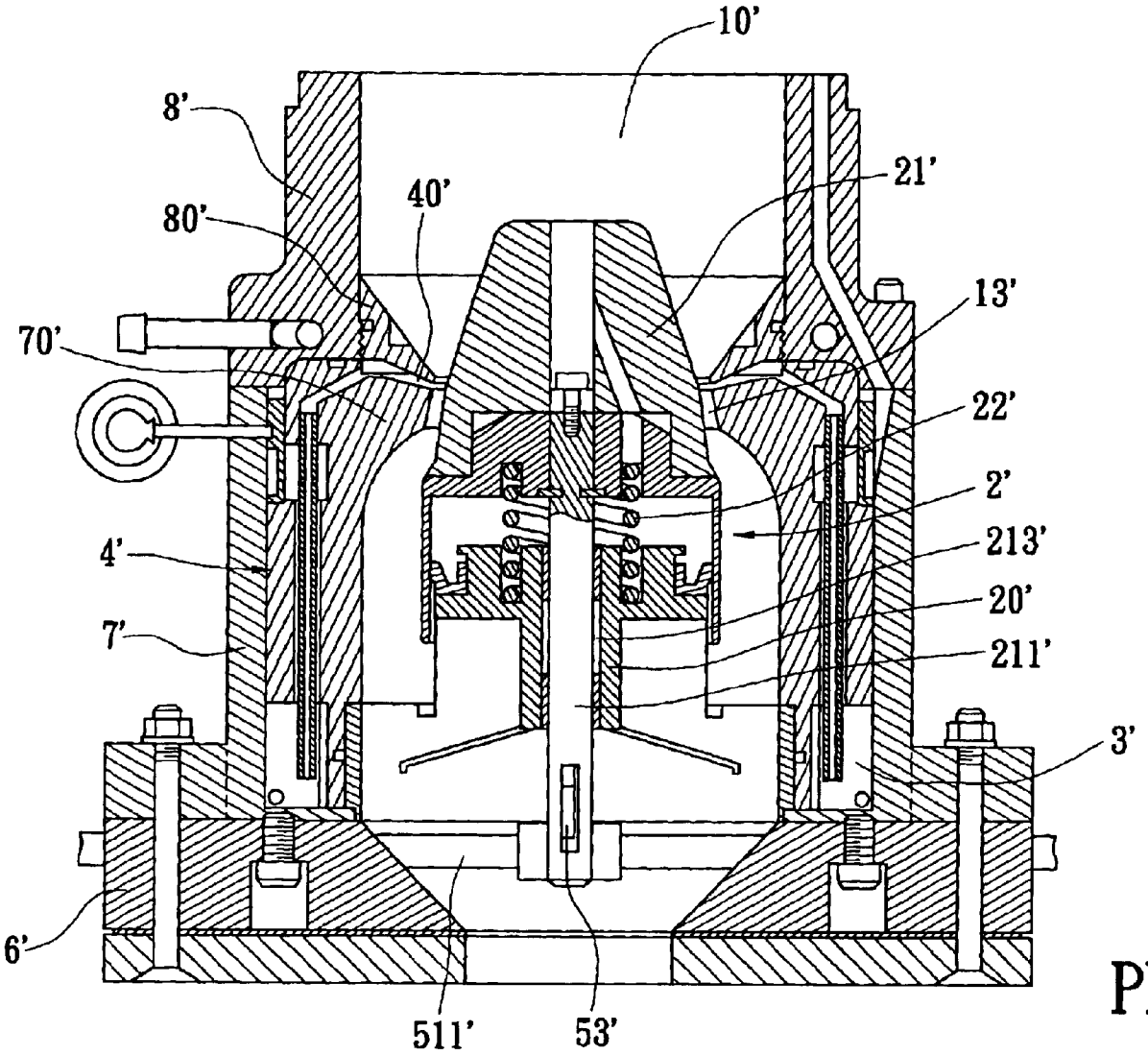
FIG. 1 PRIOR ART
FIG. 1 is a schematic, cross-sectional view illustrating a prior art variable venturi carburetor.
Figure 2:
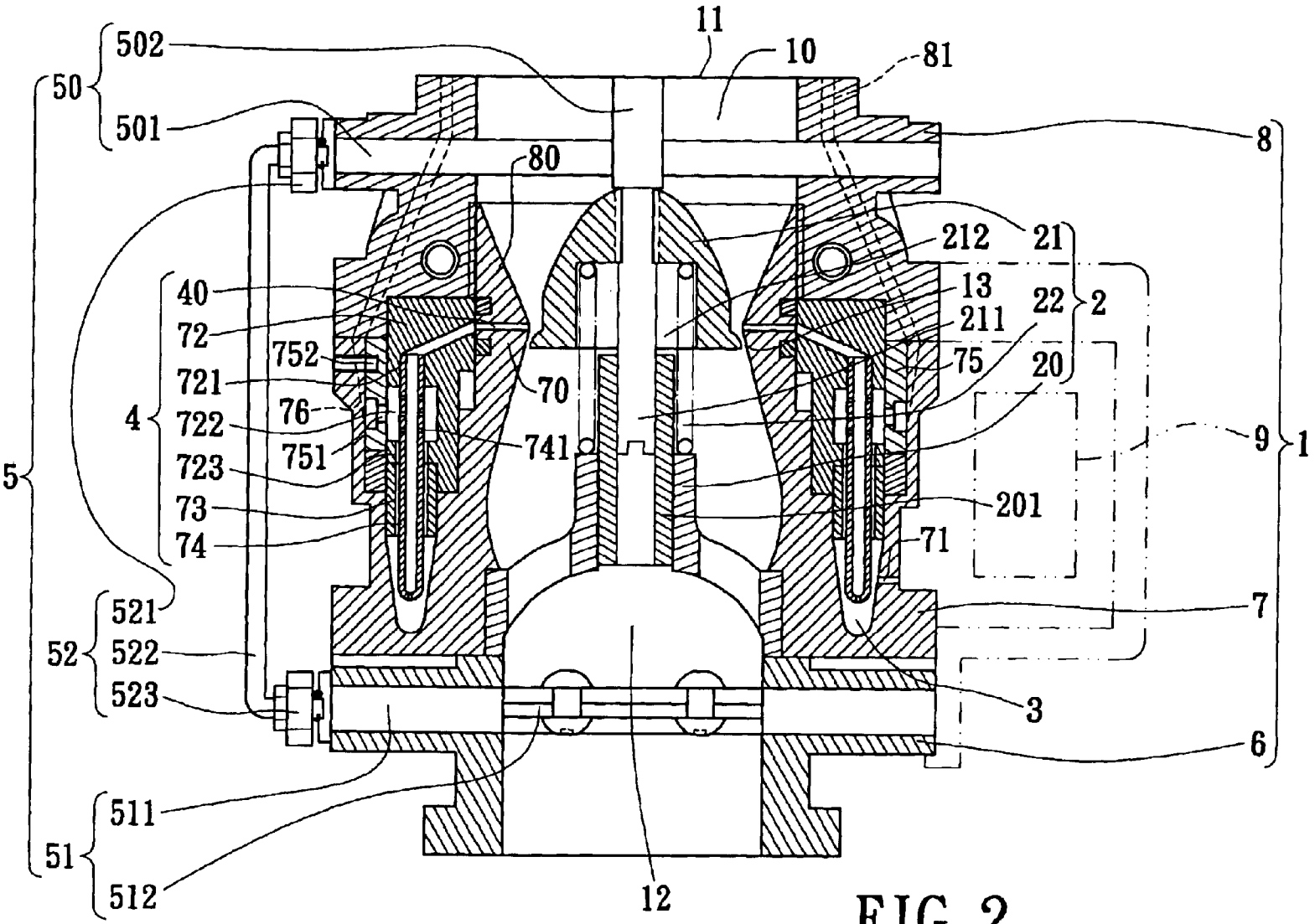
FIG. 2 is a schematic, cross-sectional diagram of the present invention.

Referring to FIG. 2 to FIG. 7, the present invention pertains to a variable venturi-type carburetor with automatic vacuum regulation and cam control mechanism for adjusting the air/fuel ratio over a wide operation range, thereby increasing the performance of engines. The variable venturi-type carburetor of the present invention comprises a base 1, a variable venturi assembly 2, a fuel reservoir 3, a path 4, and a cam control mechanism 5.

The base 1 comprises a central channel 10 comprising an open inlet end 11 and an open outlet end 12. The base 1 comprises a seat 6, a main body 7, and an upper lid 8 in sequence. The open inlet end 11 is situated at the upper lid 8. The open outlet end 12 is situated at the seat 6. The main body 7 comprises a flange 70 approaching the upper lid 8. A fixing ring 80 is fixed in the upper lid 8 and the fixing ring 80 approaches the flange 70 of the main body 7 to form an outlet channel 40.

The variable venturi assembly 2 is situated in the middle of the central channel 10. The variable venturi assembly 2 comprises a support 20, a conical body 21, and a resilient member 22. The support 20 has a lower end fixed on the main body 7 of the base 1. The support 20 comprises a center shaft sleeve 201. The conical body 21 has a lower shaft portion 211 that is movably inserted into the center shaft sleeve 201 of the support 20. An inner recess 212 is provided at the bottom of the conical body 21. The slightly curved surface of the conical body 21 and the flange 70 of the main body 7 define a venturi throat-narrowing channel 13. The resilient member 22 is installed between the conical body 21 and the support 20 to push the conical body 21 upward. One end of the resilient member 22 is restrained by the inner recess 212. An upper portion of the shaft sleeve 201 inserts into the resilient member 22. According to the preferred embodiment of the present invention, the resilient member 22 is a spring.

The fuel reservoir 3 is situated inside the main body 7 of the base 1. The fuel reservoir 3 is annular in shape. The fuel reservoir 3 has a joint hole 71 allowing the fuel reservoir 3 to connect with the fuel supply chamber 9.

The path 4 connects the fuel reservoir 3 and the outlet channel 40 to the venturi throat-narrowing channel 13.

The cam control mechanism 5 comprises cam set 50, throttle valve set 51, and connection mechanism 52. The cam set 50 comprises a camshaft 501 pivotally installed across the open inlet end of the upper lid 8 of the base 1, and a cam 502. The surface of the cam 502 abuts upon the top surface of the conical body 21 of the variable venturi assembly 2. The throttle valve set 51 comprises a throttle shaft 511 pivotally installed across the open outlet end 12 of the seat 6 of the base 1, and a throttle valve 512 controlling the air passage. The connection mechanism 52 comprises an upper arm 521, connecting rod 522, and lower arm 523. One end of the upper arm 521 is pivotally connected to the camshaft 501 of the cam set 50, and the other end of the upper arm 521 is pivotally connected to one end of the connecting rod 522. The other end of the connecting rod 522 is pivotally connected to the throttle vale shaft 511 of the throttle valve set 51.

The main body 7 comprises a retaining seat 72, sleeve 73, emulsifying tube 74, and horsepower regulation ring 75. The retaining seat 72 is annular in shape. The retaining seat 72 comprises an upper channel 721, chamber 722, and lower channel 723. The chamber 722 connects with the upper chamber 721 and the lower channel 723. The upper channel 721 connects with the outlet channel 40. The lower channel 723 connects with the sleeve 73. The lower end of the sleeve 73 is connected to the fuel reservoir 3. The top of the emulsifying tube 74 is fastened in the upper channel 721. The emulsifying tube passes through the chamber 722, the lower channel 723, and the sleeve 73. Both the inner diameter of the lower channel 723 and the inner diameter of the sleeve 73 are slightly larger than the outer diameter of the emulsifying tube 74. The lower distal end of the emulsifying tube 74 extends into the fuel reservoir 3. The number of the emulsifying tubes 74 depends upon the size of the engine. In average, there are 4 to 8 emulsifying tubes provided in the retaining seat 72. The path 4 includes the upper channel 721, the chamber 722, the lower channel 723, the sleeve 73, and the emulsifying tube 74. Vent holes 741 are provided on the emulsifying tube 74 in the chamber 722. On the horsepower regulation ring 75, vent holes 751 are provided. The horsepower regulation ring 75 moves between the main body 7 and the retaining seat 72. Vent holes 76 and 81 are respectively provided on the main body 7 and the upper lid 8 for communicating with an outer air cleaner (not shown). The horsepower regulation ring 75 rotates in an angle displacement manner to control the vent holes 751 of the horsepower regulation ring 75 to align with the vent holes 741 of the emulsifying tube 74 and the vent holes 76 of the main body 7. The horsepower regulation ring 75 also connects with the impeller mechanism 77.

Referring to FIGS. 3–8, the impeller mechanism 77 comprises the horsepower regulation ring 75 with screw hole 752. A through hole 78 is provided on the main body 7. A fixing rod 771 passes through the through hole 78 of the main body 7 and is screwed into the screw hole 752. The fixing rod 771 is connected to a vacuum valve 773, which is connected to an engine (not shown). The fixing rod 771 impels the horsepower regulation ring 75 by the engine vacuum suction force. The impeller mechanism 77 further comprises a fine tuning mechanism 79 comprising a cam 791, rotating member 792, and adjusting nut 793. The cam 791 is situated on the throttle valve shaft 511. The rotating member 792 is pivotally installed on the main body 7. The adjusting nut 793 is situated at one end of the rotating member 792. A stopping spring 794 is installed between the rotating member 792 and the adjusting nut 793. The lower distal end of the adjusting nut 793 abuts upon the surface of the cam 791. The other end of the rotating member 792 movably sleeves the fixing rod 771 such that the fixing rod 771 is able to slide in the through hole 781 of the main body 7.

Figure 3:
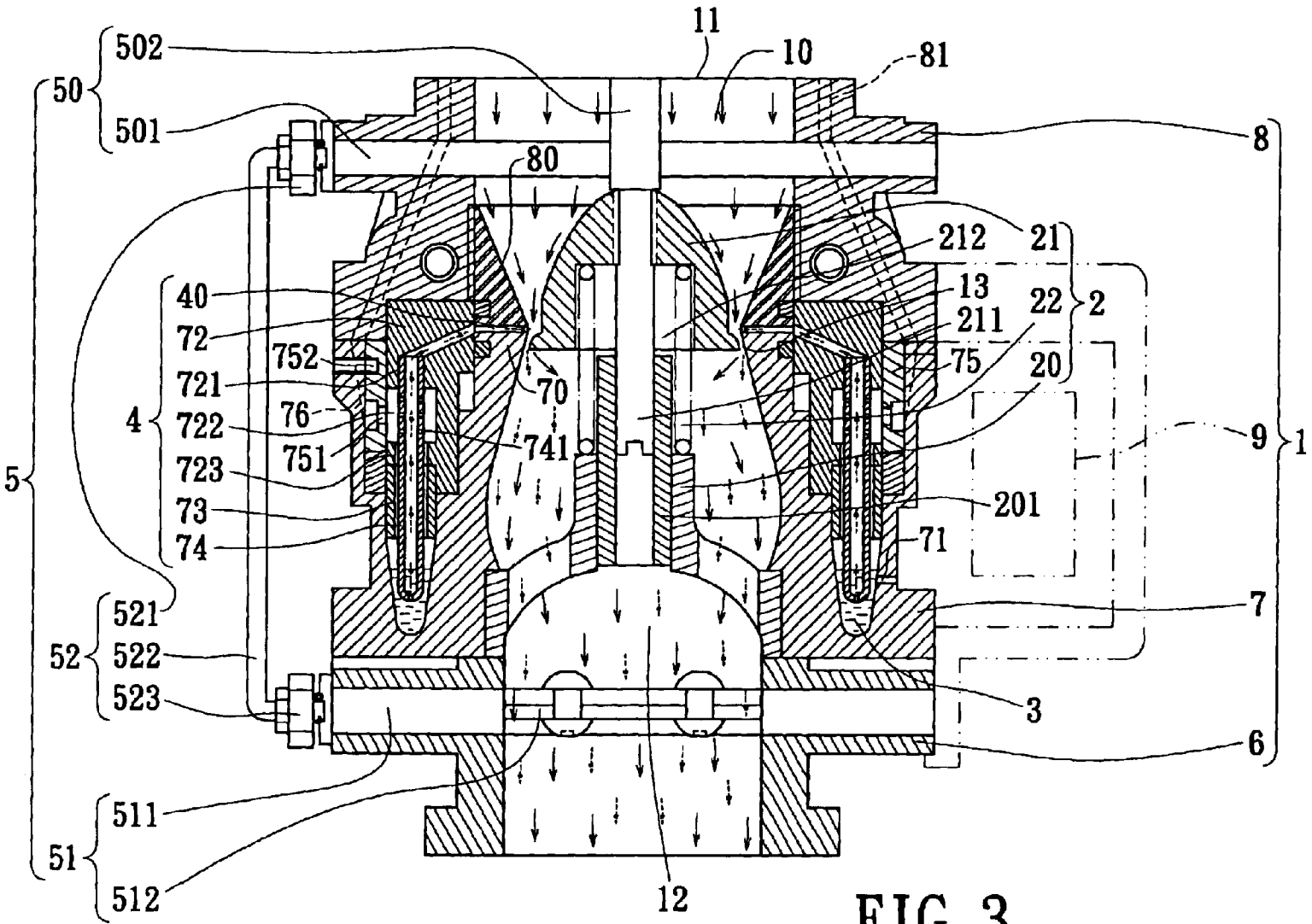
FIG. 3 is a schematic, cross-sectional diagram of the present invention (lean air-fuel mixture)
Figure 4:
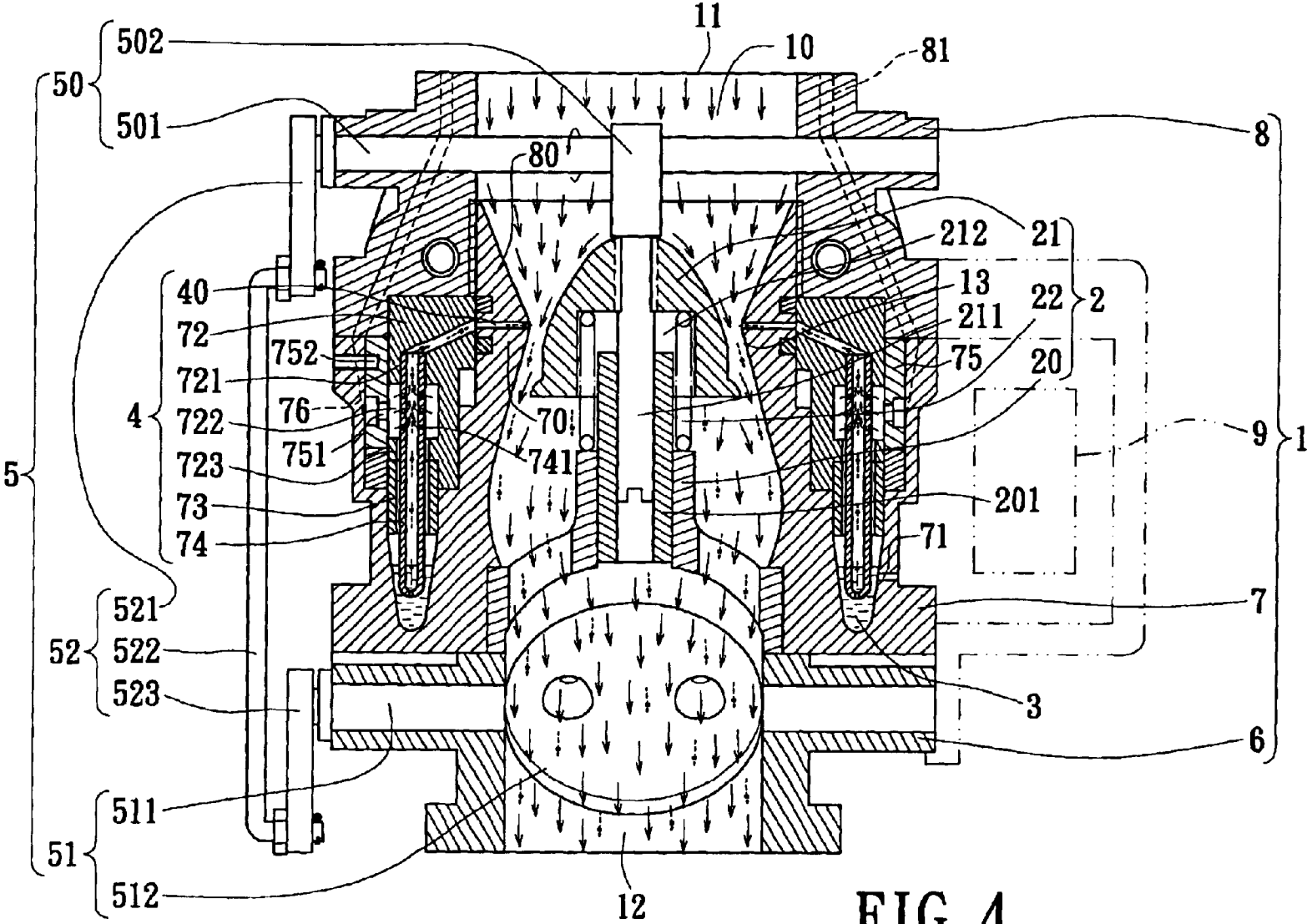
FIG. 4 is a schematic, cross-sectional diagram of the present invention (rich air-fuel mixture)

Referring to FIGS. 3 and 4, in response to the depression of the throttle pedal, the throttle valve shaft 511 rotates so that the throttle valve 512 can control the open degree of the lower outlet end 12 of the base 1, thereby generating variation of engine vacuum suction force and therefore changing engine RPM. Changes of the engine vacuum suction force results in upward and downward movement of the conical body 21 of the variable venturi assembly 2. When the engine vacuum suction force increases, the conical body 21 descends along the axis because of the suction force. When the engine vacuum suction force decreases, the conical body 21 is pushed upwardly by the resilient member 22. Meanwhile, the throttle valve shaft 511 propels the connecting mechanism 52 to rotate the camshaft 501 of the cam control mechanism 5 and also rotate the cam 502 of the cam set 50. The different positions of the cam 502 contact the top surface of the conical body 21 to restrict the ascending levels of the conical body 21. The contact positions between the top surface of the conical body 21 and the cam 502 are optimized in advance according to a number of tests, so that the emission of HC, CO, and $NO_x$, are the lowest at different engine speed. The reading of the engine vacuum is highest and stable. An optimized spacing between the conical surface of the conical body 21 and the flange 70 of the main body 7 at the venturi throat-narrowing channel 13 can be acquired to result in optimal air-fuel mixture. According to the open degree of the throttle valve 512 and the positions of the cam 502 of the cam control mechanism 5, the best position of the conical body 21 of the variable venturi assembly 2 can be acquired to achieve the goals of, for example, fuel conservation, avoiding pollution, and producing maximum horsepower.

Figure 6:
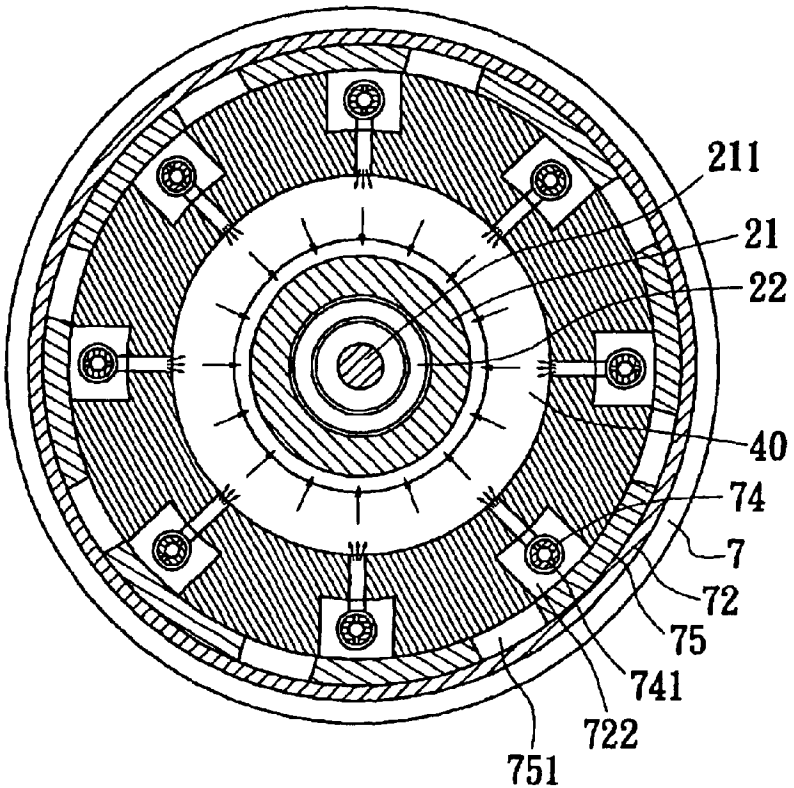
FIG. 6 is a schematic, cross-sectional top view of the present invention showing the fuel inlet from the vent holes of the emulsifying tube.
Figure 5:
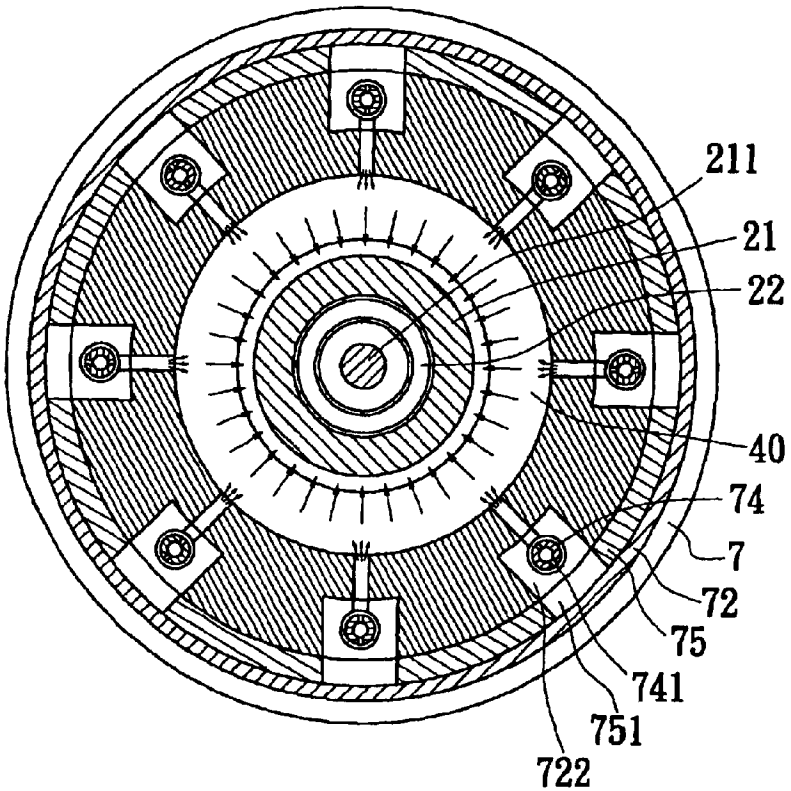
FIG. 5 is a schematic, cross-sectional top view of the present invention showing the air inlet from the vent holes of the emulsifying tube.
Figure 7:
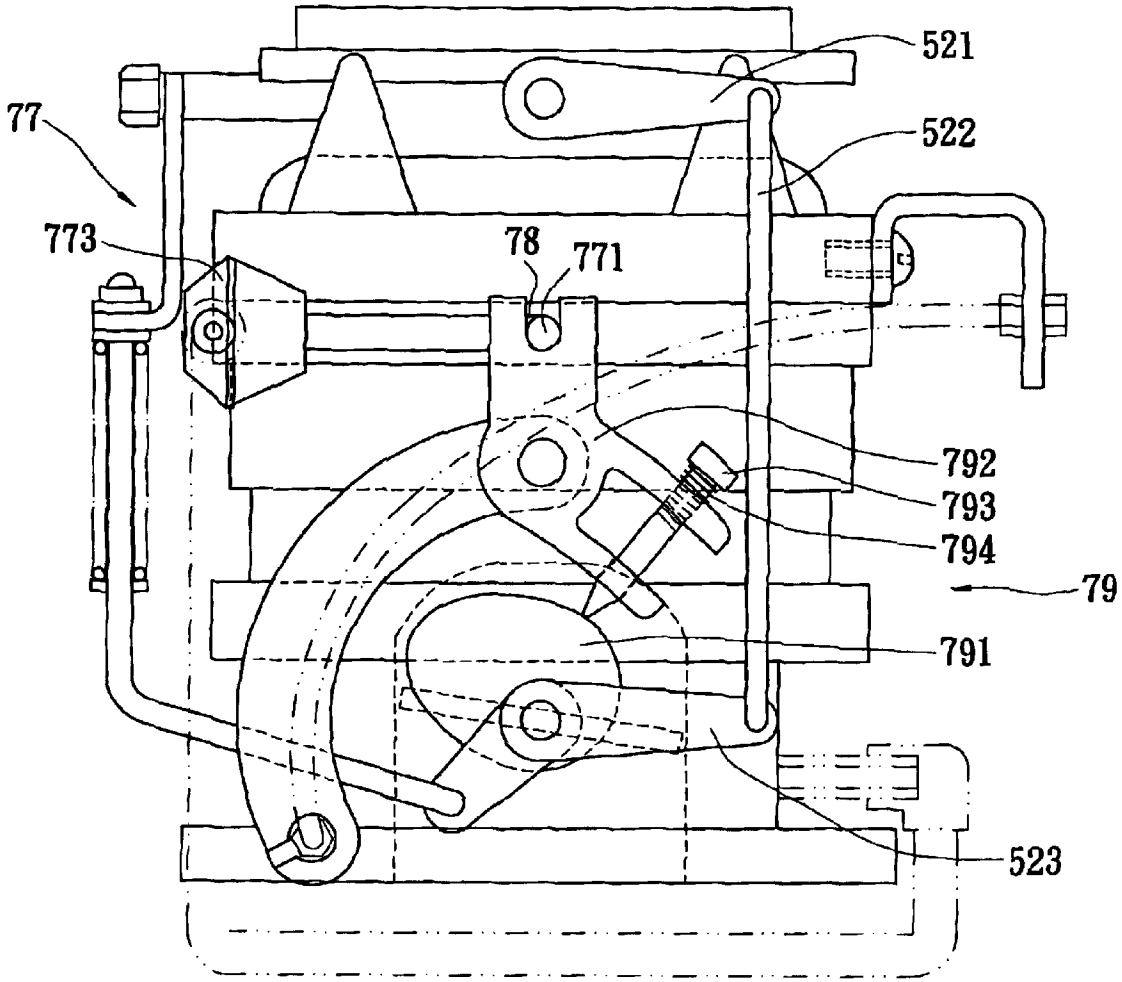
FIG. 7 is a perspective view of the fine tuning mechanism of the present invention, showing the status before acting.
Figure 8:
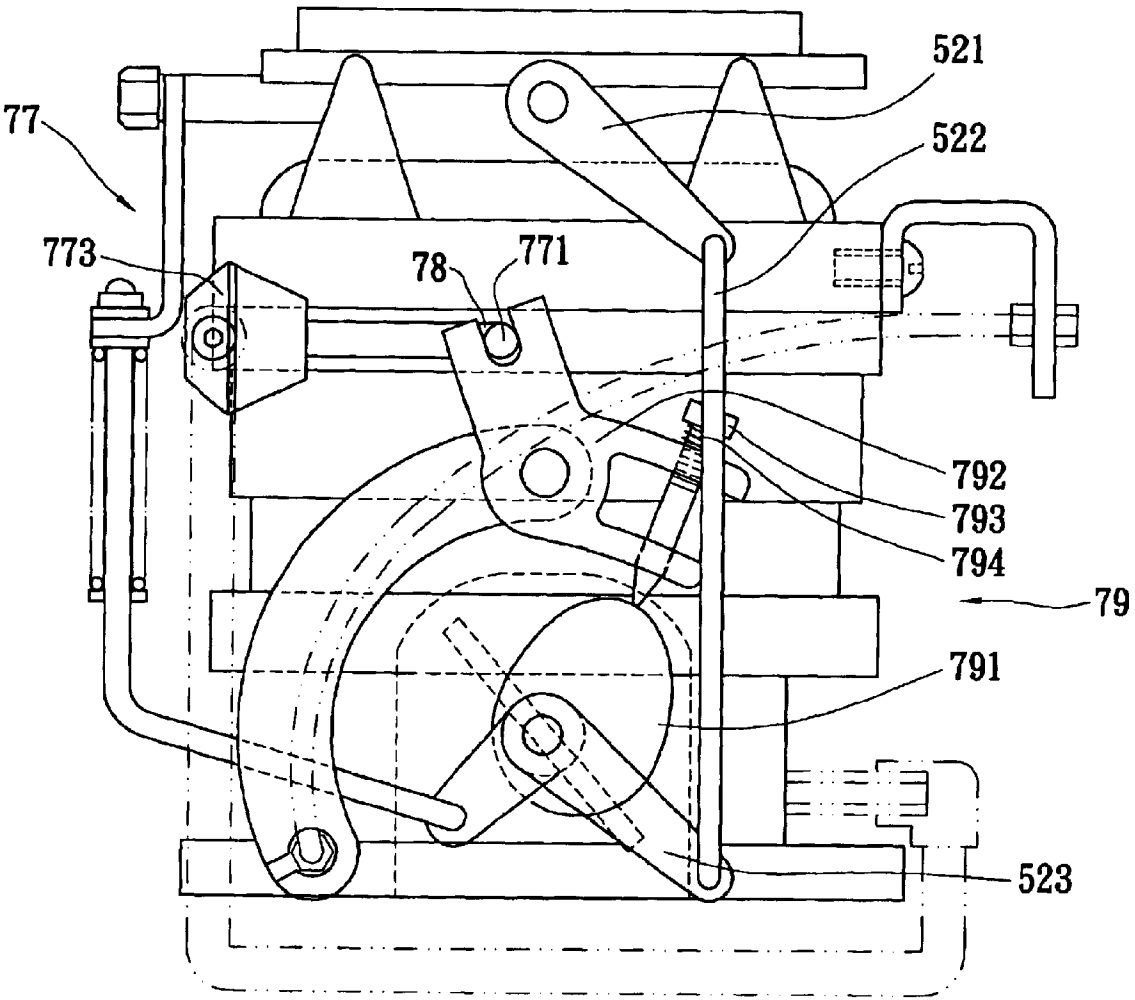
FIG. 8 is a perspective view of the fine tuning mechanism of the present invention, showing the status when acting.

Due to a capital phenomenon, an amount of fuel exists in the gap between the sleeve 73 of the main body 7 and the emulsifying tube 74. The variation of the engine vacuum suction force gives rise to changes of the vacuum valve 773 and forces the fixing nut 771 of the impeller mechanism 77 to control the rotation of the horsepower regulation ring 75. At low speeds, fuel is sucked up into the emulsifying tube 74 only through the end of the emulsifying tube 74 in the fuel reservoir 3 to provide fewer fuel sent along the path 4 to the venturi throat 13 and mixed there with the passing air from the upper inlet end 11 to produce lean fuel-air mixture at the lower outlet end 12. Under normal driving conditions, the vent holes 751 of the horsepower regulation ring 75 align with the chamber 722 of the path structure 4, as shown in FIG. 4. Alignment of the vent holes 751 and 741 results in wide-open air channel and the air enters the vent holes 751 of the horsepower regulation ring 75 from the vent holes 76 of the main body 7, then enters the vent holes 741 of the emulsifying tube 74, to obtain lean air-fuel mixture. When the engine is under a heavy loading condition, such as driving on a road with high grade, a large horsepower output is needed. The engine vacuum suction force decreases under such condition, the vacuum valve 773 actuates the fixing nut 771 such that the vent holes 751 of the horsepower regulation ring 75 misalign with the chamber 722 of the path structure 4, as shown in FIG. 6. Misalignment of the corresponding vent holes 751 and 741 results in a closed status. Fuel between the sleeve 73 and the emulsifying tube 74 enters the chamber 722 and then passes through the vent holes 741 of the emulsifying tube 74 and then enters the emulsifying tube 74 to provide a rich air-fuel mixture. Referring to FIG. 7 and FIG. 8, the fixing nut 771 actuates the rotating member 792 of the fine tuning mechanism 79 to change the position of the adjusting rod 793. The cam 791 of the fine tuning mechanism 79 rotates according to the throttle valve shaft 511 to fine tune the position of the adjusting rod 793, therefore placing the horsepower regulation ring 75 in the best position. The contact positions between the surface of the cam 791 of the fine tuning mechanism 79 and the adjusting rod 793 are adjusted according to a number of tests to ensure that the vent holes 751 of the horsepower regulation ring 75 are in the best positions, thereby providing proper fuel supply in low, middle, and high speed ranges.

To sum up, the present invention variable venturi-type carburetor with automatic vacuum regulation and cam control mechanism has the following advantages:

(1) When the throttle valve is open, the conical body of the variable venturi assembly descends because of the engine vacuum suction force. The lean air-fuel mixture results in reduced engine vacuum suction force and the resilient member pushes the conical body. The cam of the cam set of the cam control mechanism abuts upon the top surface of the conical body to restrict the ascending level of the conical body. The cam set is connected to the throttle valve set by means of the connecting mechanism, such that the spacing at the venturi throat is optimized and a proper air-fuel mixture ratio is obtained. The cam control mechanism and the engine vacuum suction force can be automatically regulated to achieve the goals of saving fuel, preventing pollution, and producing maximum horsepower output.

(2) The conical body of the variable venturi assembly is axially movable. When braking, or releasing the throttle pedal to decelerate, sudden increase of the engine vacuum suction force forces the conical body to descend, therefore increasing the spacing at the venturi throat and decreasing the air-fuel ratio (lean air-fuel mixture). Consequently, when decelerating, extra fuel consumption and air pollution can be avoided. This is more effective when a vehicle drives on city roads.

(3) Fuel supply from the fuel reservoir is more precise. This is because the vent holes of the horsepower regulation ring within the main body can tie in with vent holes of the emulsifying tube of the path structure, and also because of the fine tuning of the contact positions between the cam of the fine tuning mechanism of the impeller mechanism and the adjusting rod.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A variable venturi-type carburetor with automatic vacuum regulation and cam control mechanism, comprising:

a base defining a central channel having an upper inlet end and a lower outlet end;

a variable venturi assembly situated in a middle of the central channel, the variable venturi assembly comprising a support, a conical body, and a resilient member, wherein the support is fixed in the base, a bottom of the conical body is movably connected to the support, a surface of the conical body and the base define a venturi throat, and wherein the resilient member is situated between the support and the conical body;

a fuel reservoir provided in the base;

a path structure communicating the fuel reservoir and the venturi throat; and a cam control mechanism comprising a cam set, a throttle valve set, and a connecting mechanism, wherein the cam set is pivotally installed at the upper inlet end of the base, and a cam surface of the cam set abuts upon a top surface of the conical body of the variable venturi assembly, wherein the throttle valve set is pivotally installed at the lower outlet end of the base, and the throttle valve set comprises a throttle valve for controlling the open/close of the lower outlet end, and wherein the connecting mechanism has one end connected to the cam set and another end connected to the throttle valve set.

2. The variable venturi-type carburetor with automatic vacuum regulation and cam control mechanism according to claim 1, wherein the base comprises a seat, a main body, and an upper lid in sequence, the open inlet end is situated at the upper lid and the open outlet end is situated at the seat, the throttle valve set comprises a throttle valve shaft pivotally installed at the base, the cam set comprises a camshaft pivotally installed at the upper lid, the connecting mechanism comprises an upper arm, connecting rod, and lower arm, one end of the upper arm is pivotally connected to the camshaft of the cam set, another end of the upper arm is pivotally connected to one end of the connecting rod, and another end of the connecting rod is pivotally connected to the throttle valve shaft of the throttle valve set.

3. The variable venturi-type carburetor with automatic vacuum regulation and cam control mechanism according to claim 1, wherein the base comprises a seat, a main body, and an upper lid in sequence, the open inlet end is situated at the upper lid, the open outlet end is situated at the seat, a bottom of the support of the variable venturi assembly is fixed in the base, the support comprises a center shaft sleeve, the conical body has a lower shaft portion movably inserted into the center shaft sleeve of the support, an inner recess is provided at the bottom of the conical body, a slightly curved surface of the conical body and a flange of the main body define a venturi throat narrowing channel, the resilient member is installed between the conical body and the support to push the conical body upward, one end of the resilient member is restrained by the inner recess, an upper portion of the shaft sleeve inserts into the resilient member, and the path connects the fuel reservoir and the outlet channel to the venturi throat narrowing channel.

4. The variable venturi-type carburetor with automatic vacuum regulation and cam control mechanism according to claim 3, wherein the fuel reservoir is situated inside the main body of the base, the fuel reservoir is annular in shape, the fuel reservoir has a joint hole allowing the fuel reservoir to connect with the fuel supply chamber, the main body comprises a retaining seat, sleeve, emulsifying tube, and horsepower regulation ring, the retaining seat is annular in shape, the retaining seat comprises an upper channel, chamber, and lower channel, the chamber connects with the upper chamber and the lower channel, the upper channel connects with the outlet channel, the lower channel connects with the sleeve, the lower end of the sleeve is connected to the fuel reservoir, the top of the emulsifying tube is fastened in the upper channel, the emulsifying tube passes through the chamber, the lower channel, and the sleeve, both the inner diameter of the lower channel and the inner diameter of the sleeve are slightly larger than the outer diameter of the emulsifying tube, the lower distal end of the emulsifying tube extends into the fuel reservoir, the number of the emulsifying tubes depends upon the size of the engine, the path includes the upper channel, the chamber, the lower channel, the sleeve, and the emulsifying tube, vent holes are provided in the emulsifying tube in the chamber, vent holes are provided in the horsepower regulation ring, the horsepower regulation ring moves between the main body and the retaining seat, vent holes are respectively provided in the main body and the upper lid for communicating with an outer air cleaner, the horsepower regulation ring rotates in angle displacement manner to control the vent holes of the horsepower regulation ring to align with the vent holes of the emulsifying tube and the vent holes of the main body, and the horsepower regulation ring also connects with an impeller mechanism.

5. The variable venturi-type carburetor with automatic vacuum regulation and cam control mechanism according to claim 4, wherein the impeller mechanism comprises the horsepower regulation ring with screw hole, a through hole is provided in the main body, a fixing rod passes through the through hole of the main body and is screwed into the screw hole, the fixing rod is connected to a vacuum valve, the vacuum valve is connected to an engine and the fixing rod impels the horsepower regulation ring by the engine vacuum suction force.

6. The variable venturi-type carburetor with automatic vacuum regulation and cam control mechanism according to claim 5, wherein the impeller mechanism further comprises a fine tuning mechanism comprising a cam, rotating member, and adjusting nut, the cam is situated on the throttle valve shaft, the rotating member is pivotally installed on the main body, the adjusting nut is situated at one end of the rotating member, a stopping spring is installed between the rotating member and the adjusting nut, the lower distal end of the adjusting nut abuts upon the surface of the cam, and another end of the rotating member movably sleeves the fixing rod such that the fixing rod is able to slide in the through hole of the main body.

7. The variable venturi-type carburetor with automatic vacuum regulation and cam control mechanism according to claim 6, wherein a stopping spring is installed between the rotating member and the adjusting nut.

* * * * *